United States Patent [19]

Kuhnke

[11] 3,952,436

[45] Apr. 27, 1976

[54] DEVICE FOR LOCKING A FRAMED PICTURE TO A WALL

[76] Inventor: Horst Kuhnke, 9 Echo Court, Hawthorn Woods, Ill. 60047

[22] Filed: July 7, 1975

[21] Appl. No.: 593,758

[52] U.S. Cl. ..... 40/152.1; 248/203; 248/488

[51] Int. Cl.[2] ..... G09F 1/12

[58] Field of Search ..... 40/152.1, 152, 152.2, 40/156, 201, 202, 203; 248/203, 488, 490, 479

[56] References Cited

UNITED STATES PATENTS

| | | | |
|---|---|---|---|
| 2,820,311 | 1/1958 | Hamlin | 40/156 |
| 2,928,199 | 3/1960 | Novak | 40/152.1 |
| 3,254,438 | 5/1966 | Filary et al. | 40/156 |
| 3,347,504 | 10/1967 | Goss | 248/488 |
| 3,668,798 | 6/1972 | Mehl | 40/152.1 |
| 3,709,456 | 1/1973 | Pietsch | 248/203 X |

FOREIGN PATENTS OR APPLICATIONS

| | | | |
|---|---|---|---|
| 1,070,964 | 2/1954 | France | 40/156 |
| 24,992 | 3/1963 | Germany | 40/156 |

*Primary Examiner*—Russell R. Kinsey
*Assistant Examiner*—John F. Pitrelli
*Attorney, Agent, or Firm*—Norman A. Witt

[57] ABSTRACT

The framed picture locking device includes a body of generally disk shape, an arm extending from the body which in lock position engages a part of the picture frame and urges it against the wall. The body additionally functions to prevent lateral movement of the frame and upward movement of the frame.

7 Claims, 9 Drawing Figures

DEVICE FOR LOCKING A FRAMED PICTURE TO A WALL

This invention relates in general to hanging framed pictures or paintings on a wall, and more particular to locking the framed pictures or paintings to the wall to prevent removal from the wall except by use of a special tool or wrench.

Heretofore, it has been common to mount framed pictures or paintings or the like onto walls by utilizing hooks, nails and other fasteners secured to the wall, together with hooks, wires and the like secured to the framed unit to be hung on the wall. It has also been known to fasten certain framed pictures and the like to walls in a somewhat permanent manner by using fasteners or by using screws that will be received in holes of the framed unit. Such manner of securing a framed unit to a wall requires considerable work when it is desired to remove it from the wall. Accordingly, it is normal to merely hang a framed unit onto a wall so that it can be easily removed when desired. Unfortunately, this manner of hanging exposes the framed unit for easy removal by unauthorized persons.

It is therefore an object of the present invention to provide a device for locking a framed unit such as a picture or a painting to a wall to prevent removal by unauthorized persons and to permit easy removal by authorized persons having access to a special tool or wrench.

A further object of this invention is in the provision of a device for locking a framed unit to a wall which coacts with conventional hanging techniques and parts and which prevents the framed unit from being moved away from the wall, upwards or sidewards.

A still further object of the present invention is to provide a device for mounting framed units to a wall which can be adjusted to handle different frame structures.

Other objects, features and advantages of the invention will be apparent from the following detailed disclosure, taken in conjunction with the accompanying sheet of drawings, wherein like reference numerals refer to like parts, in which.

Figure 1:
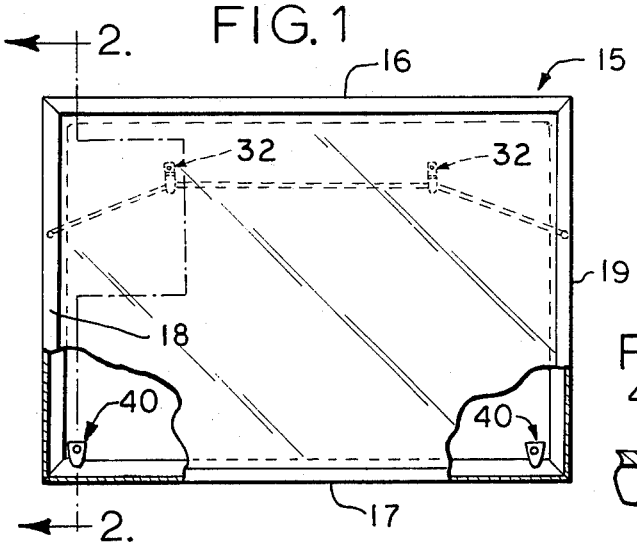
FIG. 1 is an elevational view of a framed unit such as a picture or painting hung on a wall and locked into position by a device of the invention and with some parts broken away to show underlying parts and other underlying parts in dotted lines.

The locking device of the present invention, when utilized to lock a rectangularly shaped frame unit to a wall as illustrated in the drawings, is used in duplicate where one locking device is arranged to coact with each lower corner of the frame. It should be appreciated that one or more of the locking devices may be used with certain framed units as needed to provide the desired locking action which will prevent easy removal of the framed unit from a wall. For example, if the framed unit is circular in shape, it may be possible to get by with a single locking member, or it may be necessary to use more than two locking members. The present invention contemplates use of a locking member in such a way as to obtain the desired results of locking a framed unit to a wall so that unauthorized personnel cannot easily move the framed unit. It is important in the present invention that the locking device can be manipulated between lock and unlock positions only by a special tool, as once a framed unit, such as a picture, is locked to a wall with the present invention, it can only be properly removed with the special tool unless it be severely damaged. While the tool illustrated is forked or bifurcated, it should be appreciated other types of tools may be designed. The locking device includes a generally disk-shaped body having an arm extending therefrom in superposed relation and a wrench-engaging portion positioned on the side of the body adjacent the wall. The arm is positioned on the side of the body away from the wall. The device is mounted to the wall by means of a suitable fastener which allows the device to rotate on the fastener. When the device is in lock position, the arm engages and overlaps a portion of the frame to prevent the frame from being moved away from the wall, while the body engages portions of the frame to prevent upward or sideward movement of the frame. Accordingly, utilization of the special tool enables rotation of the locking device between unlock position and lock position, thereby allowing authorized personnel to easily remove a framed unit from a wall, if so desired.

Figure 2:
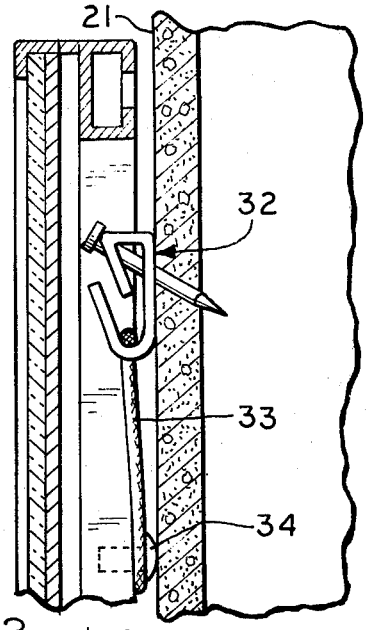
FIG. 2 is a vertical broken sectional view taken substantially along line 2—2 of FIG. 1.

Referring now to the drawings and particularly to FIG. 1, a framed unit 15 in the form of a picture frame is shown mounted on a wall by being hung by conventional means and by being locked to the wall by the locking device of the present invention, and the unit includes upper and lower frame rails 16 and 17 and opposing side frame rails 18 and 19. As already explained, the frame unit illustrated is rectangular in shape but it may be square, circular or of any other desired polygonal shape, and still utilize the present invention. Each of the frame rails includes the same cross-sectional configuration, as illustrated in FIG. 2, wherein an outer wall 20 extending substantially perpendicular to the wall 21 onto which the framed unit is to be mounted, generally defines a border for the framed unit. A forward retaining flange 22 provides a bearing surface against which a glass panel 23 may engage. A picture 24 is arranged adjacent and behind the glass panel 23 and may be held in place in the frame by any suitable means. About midway of the depth of the outer wall 20, an inwardly extending lip 24 extending substantially parallel to the wall 21 defines structure for coacting engagement with the locking device of the invention, as will be more clearly hereinafter explained. At the inner end of the lip 24, a rearwardly extending bar portion 25 is provided which terminates in a rear flange 26. Similarly, the rearward edge of the outer wall 20 terminates in a rear flange 27 which is aligned with the rear flange 26.

The framed unit illustrated is conventionally hung on the wall by means of conventional hooks or hangers 32 that are conventionally fastened to the wall 21 and which receive a wire hanger 33 suitably secured at opposite ends to the side rails 18 and 19 of the frame 15, such as by fasteners 34. While not shown, it can be appreciated that alternatively screws or nails may be fastened into the wall 21 and hooks may be fastened to the framed unit for coacting with the screws or nails, all in a conventional manner. It can be further appreciated that the framed unit can easily be mounted onto the wall by bringing the wire into engagement with the hook assembly 32, as shown in FIG. 1, wherein the framed unit would be arranged adjacent the wall and moved downwardly until the wire 33 engages and hooks on the hook assembly 32. This hanging prevents further downward movement of the unit.

Figure 3:
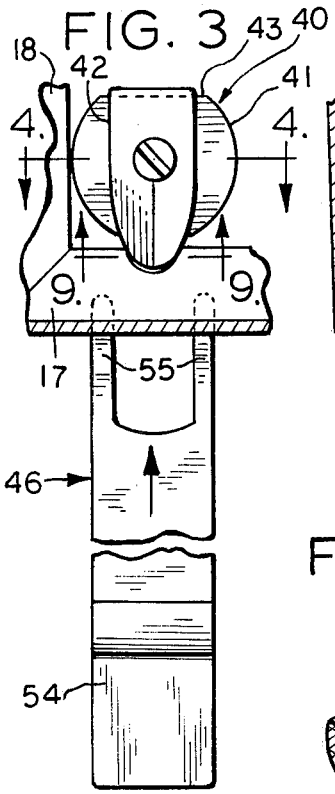
FIG. 3 is a detailed front elevational view of a single locking device and showing how the special tool coacts with the locking device and taken substantially along the line 3—3 of FIG. 2.
Figure 6:
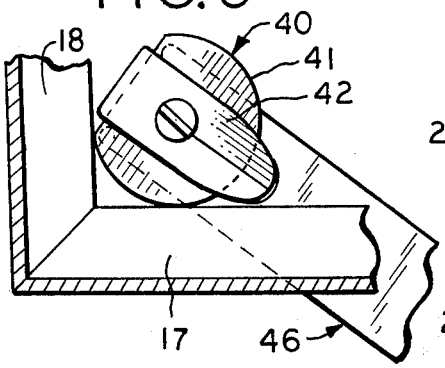
FIG. 6 is a view similar to FIG. 3 which shows the locking device in lock position except that the locking device is rotated to unlock position.
Figure 6:
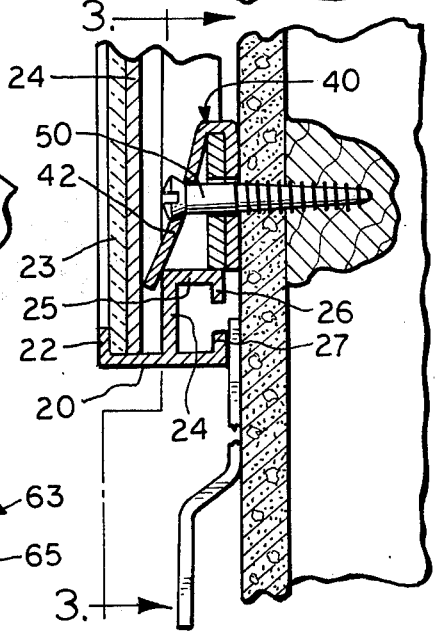
Figure 5:
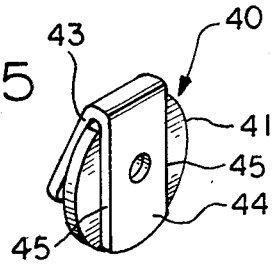
FIG. 5 is a rear perspective view of a single locking device according to the invention.

The locking device of the invention is indicated by the numeral 40 as seen in FIGS. 3, 5 and 6 includes generally a disk-shaped body 41 and a locking arm 42. The disk-shaped body has a flatted portion 43 at the upper end. While the locking device is preferably made of metal, it can be appreciated it could be made of plastic. The locking arm 42 is a part of a piece of spring steel preferably which additionally includes a tool or wrench-engaging portion 44 on the side of the disk opposite to the location of the arm 42 suitably secured thereto, such as by soldering, spot welding, riveting or the like. The wrench-engaging portion defines with the disk 41 a pair of parallel opposed surfaces 45 adapted to be engaged by a forked or bifurcated tool or wrench 46. The device 40 is constructed so that the arm 42 normally extends at an incline and away from the body 41 and suitable holes are provided through the arm 42, body 41 and wrench-engaging portion 44 to receive a suitable fastener, such as a screw 50, as seen particularly in FIGS. 2 and 8. The screw 50 is adapted to enter the holes of the locking device and embed in the wall 21 and to permit rotation of the locking device on the screw. Further, the arm 42, being of spring steel, is adjustably positionable relative the body 41 by turning the screw 50 more or less into the wall to accommodate different frame designs.

The wrench or tool 46 includes an offset handle 54 and a pair of tines 55 sized to engage the wrench-engaging surfaces 45 of the wrench-engaging portion 44, as illustrated particularly in FIGS. 2, 3 and 6.

Figure 9:
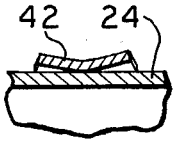
FIG. 9 is a horizontal sectional view taken substantially along the line 9—9 of FIG. 3.

When the locking device is mounted on a wall, such as shown in FIG. 2, it is arranged so that it will coact with a corner of the framed unit, as seen where two locking devices 40 in FIG. 1 coact with the two lower corners of the framed unit. In this respect, the peripheries of the bodies 41 will engage the rearwardly extending bar portions 25 of the lower rail 17 and the adjacent side rails 18 and 19 to prevent movement of the framed unit upwards or sidewards. The locking tool 46 is shown to be relatively thin so that it can slip in behind the frame of the picture, as shown in FIG. 2, for engagement with the wrench-engaging portion 44 of a locking device, and so that the locking device may be rotated between lock position, as shown in FIG. 3, and unlock position, as shown in FIG. 6. Inasmuch as the spring arm 42 will tend to draw the frame flush with the wall, it may be necessary to force the frame slightly away from the wall before the wrench is moved into position with the wrench-engaging portion of the device to rotate the device into unlock position. In order to facilitate the engagement of the locking arm 42 with the inwardly extending lip 24 of the frame, as seen in FIG. 9, the arm is somewhat flared so that it can easily cam into place. Additionally, the end of the arm is rounded to facilitate engagement with the frame.

Figure 7:
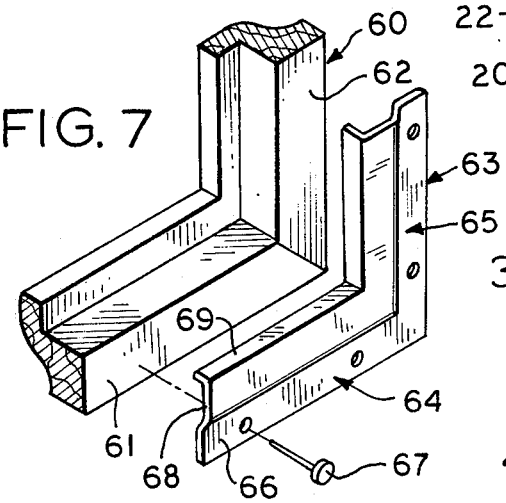
FIG. 7 is a broken perspective view of a part of a frame and an adapter to be mounted onto the frame for facilitating use of the locking device of the invention.
Figure 4:
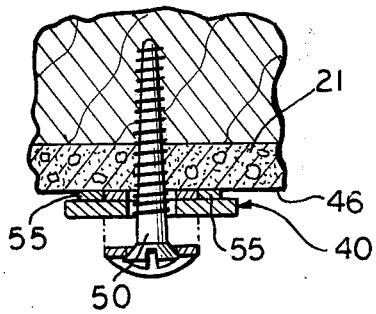
FIG. 4 is a horizontal sectional view taken through a locking device and generally along the line 4—4 of FIG. 3.
Figure 8:
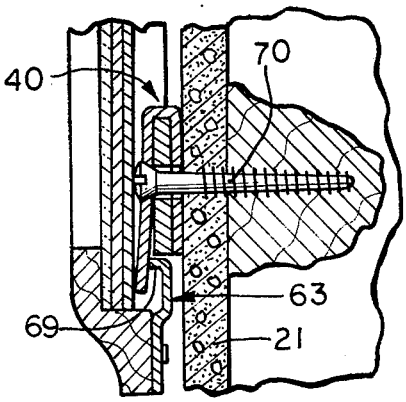
FIG. 8 is a vertical sectional view similar to FIG. 2 but illustrating the manner in which the locking device engages the adapter shown in FIG. 7.

It can be appreciated that a frame of a picture or painting or the like may not normally include a lip like the lip 24 of the frame 15. It may therefore be necessary to mount an adapter onto the frame for utilization of the locking device of the present invention. Such a structure is illustrated in FIG. 7, wherein the frame, generally designated by the numeral 60 and which includes a lower rail 61 and a side rail 62, may have mounted thereon an adapter 63 in the form of an L-shaped body which includes a first bar portion 64 and a second bar portion 65 extending at right angles thereto. The cross-sectional configuration of the bar portions is identical wherein each bar portion includes a mounted flange 66 with suitable holes for receiving fasteners 67 so that it may be secured to the frame, wherein the mounting flange abuts directly against the frame rails. Extending from the mounting flange is an offset portion 68 terminating in an inwardly extending lip 69, which is adapted to be arranged in position for engagement with the locking arm of the locking device, as shown in FIG. 8. It may be noted that the fastener 70 in FIG. 4 mounting the locking device onto the wall 21 is screwed deeper into the wall for the purpose of adjusting the position of the locking arm to firmly engage the lip 69 of the adapter 63, as shown in FIG. 8. The lip also functions to engage with the body 41 of the locking device to again prevent upward and sideward movement of the framed picture when the picture is properly mounted on the wall in relation to the locking devices. Accordingly, it can be appreciated a framed unit can be modified for easy use with the locking device of the present invention.

It will be understood that modifications and variations may be effected without departing from the scope of the novel concepts of the present invention, but it is understood that this application is to be limited only by the scope of the appended claims.

The invention is hereby claimed as follows:

1. A device for locking a picture or the like in a frame to a wall, wherein the framed picture is hung at its upper end by conventional means, said device comprising a body, an arm connected to and extending from the body along one side thereof, a fastener for mounting the body and arm to the wall, hole means through the arm and body for receiving said fastener so as to secure the device to the wall and allow the device to rotate on the fastener, said body and arm coacting with the frame to selectively lock the framed picture substantially flush to the wall when rotated to lock position or permit the same to be removed therefrom when rotated to unlock position, and a wrench-engaging portion on said body adapted to be engaged by a wrench and rotated between lock and unlock positions when the frame is substantially flush with the wall said wrench-engaging portion being on the side of the body adjacent the wall.

2. A device as defined in claim 1, wherein said body is generally disk-shaped.

3. A device as defined in claim 2, wherein said arm terminates beyond the periphery of the body and is cross-sectionally somewhat V-shaped to facilitate engagement with the frame.

4. A device as defined in claim 3, wherein said wrench-engaging portion includes a pair of spaced parallel faces for receiving a forked wrench.

5. A device as defined in claim 1, wherein an adapter having a lip is mounted on the frame for engagement with the arm which applies a force to the frame in the direction of the wall.

6. A device as defined in claim 1, wherein said frame includes a lip for engagement with said arm so that the arm will apply a force to the frame in the direction of the wall.

7. A device as defined in claim 6, wherein said arm is adjustable to provide a snug engagement with the lip depending upon the distance between the lip and wall when the frame is flush with the wall.

* * * * *